US005913296A

United States Patent [19]

McNeill

[11] Patent Number: 5,913,296

[45] Date of Patent: Jun. 22, 1999

[54] DISPOSABLE MODULAR FUEL CONTAINER FOR INTERNAL COMBUSTION ENGINES

[75] Inventor: Paul Edward McNeill, Charlotte, N.C.

[73] Assignee: Deere & Company, Charlotte, N.C.

[21] Appl. No.: 08/940,210

[22] Filed: Sep. 30, 1997

[51] Int. Cl.[6] ..... F02B 77/00

[52] U.S. Cl. ..... 123/198 R; 123/527; 220/905

[58] Field of Search ..... 123/527, 198 R, 123/516, 510; 220/905, DIG. 33; 222/173

[56] References Cited

U.S. PATENT DOCUMENTS

| | | | |
|---|---|---|---|
| 1,718,603 | 6/1929 | Smith . | |
| 2,961,014 | 11/1960 | Appleton | 141/343 |
| 3,580,423 | 5/1971 | Gilman | 222/81 |
| 3,613,955 | 10/1971 | Wetherell, Jr. | 222/83 |
| 3,731,846 | 5/1973 | Turner et al. | 222/86 |
| 4,445,550 | 5/1984 | Davis et al. | 141/329 |
| 4,648,532 | 3/1987 | Green | 222/82 |
| 4,901,890 | 2/1990 | Mivelaz | 222/395 |
| 4,982,875 | 1/1991 | Pozzi et al. | 222/83 |
| 5,701,855 | 12/1997 | Kurihara et al. | 123/73 |
| 5,799,640 | 9/1998 | Sugimoto et al. | 123/527 |

*Primary Examiner*—Thomas N. Moulis
*Attorney, Agent, or Firm*—Perman & Green, LLP

[57] ABSTRACT

A fuel supply system is described which allows the use of a disposable fuel tank prefilled with the required fuel mixture. The system includes a mounting bracket having a fuel coupling, a disposable tank, and a venting manifold.

11 Claims, 5 Drawing Sheets

DISPOSABLE MODULAR FUEL CONTAINER FOR INTERNAL COMBUSTION ENGINES

BACKGROUND OF THE INVENTION

With the proliferation of small engine driven tools such as string trimmers, blowers, brush cutters, lawn mowers and similar appliances, concerns have arisen with regard to their environmental impact on air and ground contamination. The use of such tools creates gases which add to the overall level of air pollution and their refueling may result in spills which on a cumulative basis could cause damage. There is therefore a need to provide fuel in a prefilled container which will minimize the need for user interaction. This would avoid spillage and the improper use of fuels. In the case of two cycle engines an accurate fuel to oil mixture could be supplied thereby improving the emissions of such tools.

It is therefore, the purpose of this invention to construct a fuel tank which may be filled with a fuel that is optimized for the particular tool or application including oil and other additives. This will result in improved engine performance, reduced maintenance, longer life, and reduced emissions. The tank is designed to be easily installed in the tool and removed when empty. Another purpose is to construct a low cost fuel tank which is disposable and preferably recyclable.

SUMMARY OF THE INVENTION

The invention of this application involves a fuel supply system for internal combustion engines which includes a disposable and recyclable fuel tank. A tank support bracket is designed to fit a particular engine and is constructed to receive and secure a fuel tank of more universal shape and design. The bracket includes a coupling which mates with a coupling fixed to the fuel tank. The fuel tank communicates with the carburetor of the engine through a manifold which is connected in the feed means to the engine, independently of the tank, to provide a junction for the fuel feed line, a purge line, a vent, and a liquid seal for the feed line.

DESCRIPTION OF THE DRAWING

The invention of this application is described in more detail below with reference to the Drawing in which.

DESCRIPTION OF THE PREFERRED EMBODIMENT

Figure 1:
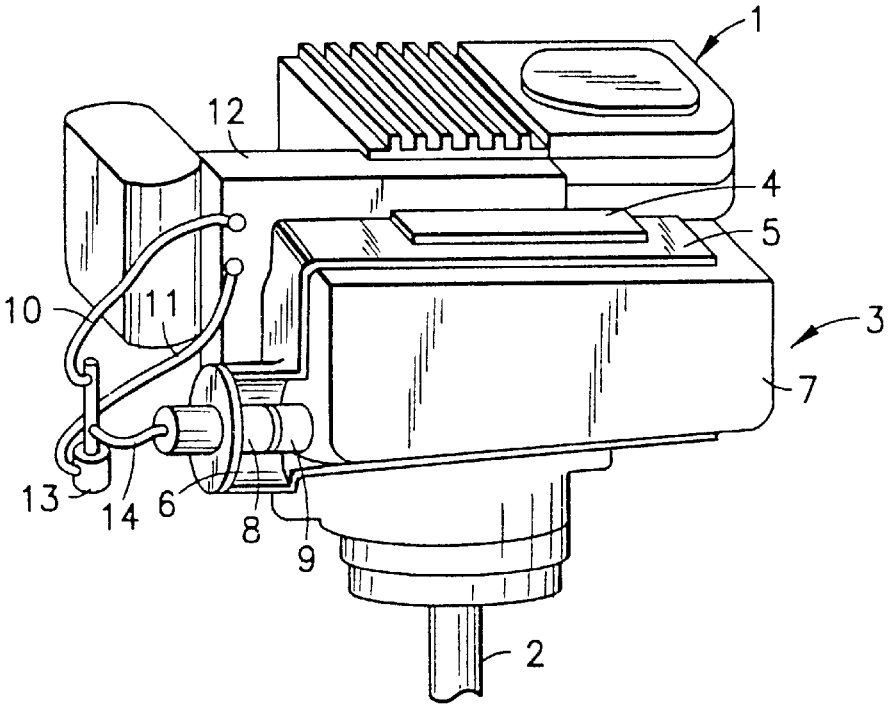
FIG. 1 is a perspective view of an engine in which is mounted the fuel supply system of this invention.

For ease of illustration, the invention is described in the context of a two cycle string trimmer engine 1, as shown in FIG. 1. It should be noted that the fuel tank system described may be used in a wide variety of applications including lawn mowers, brush cutters, blowers, chain saws and other similar tools. Engine 1 drives a shaft 2 in a well known manner. A disposable fuel supply system 3 is mounted on the engine by means of a metal flange 4. The system 3 includes a molded plastic bracket 5 which has a spout 6 extending therefrom. Fuel tank 7 is removably secured to the bracket 5. A female coupling 8 is installed in spout 6 for engagement with a mating coupling 9 installed on tank 7. The carburetor 12 of engine 1 is connected to the fuel system by fuel lines 10 and 11 and manifold 13. Manifold 13 receives fuel through tank outlet 14 and vents the fuel supply system 3.

Figure 4:
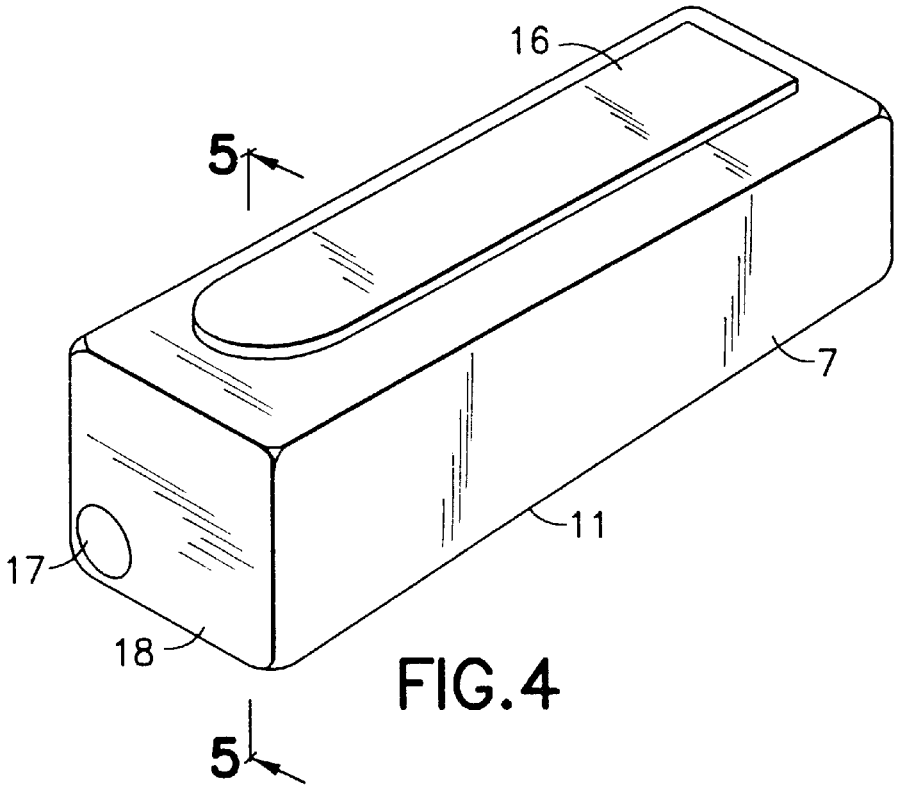
FIG. 4 is a perspective view of the fuel tank of this invention.
Figure 5:
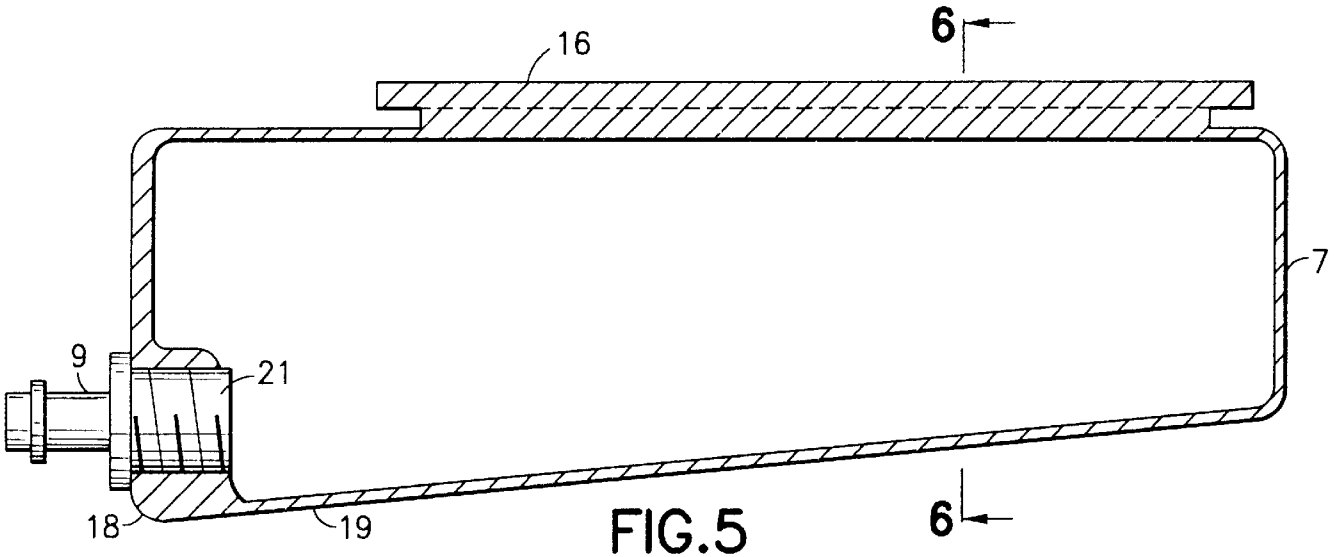
FIG. 5 is sectional view of the fuel tank of FIG. 4 taken along section lines 5—5.
Figure 6:
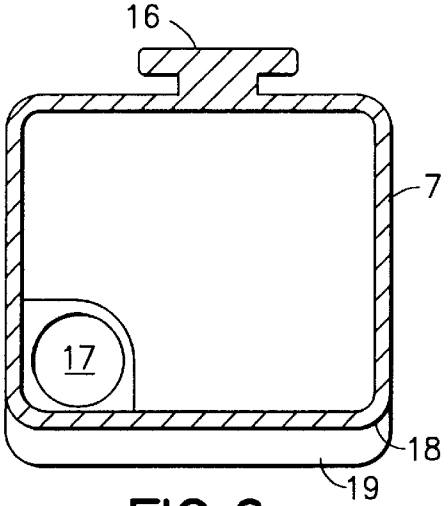
FIG. 6 is sectional view of the fuel tank of FIG. 4 taken along section lines 6—6.
Figure 7:
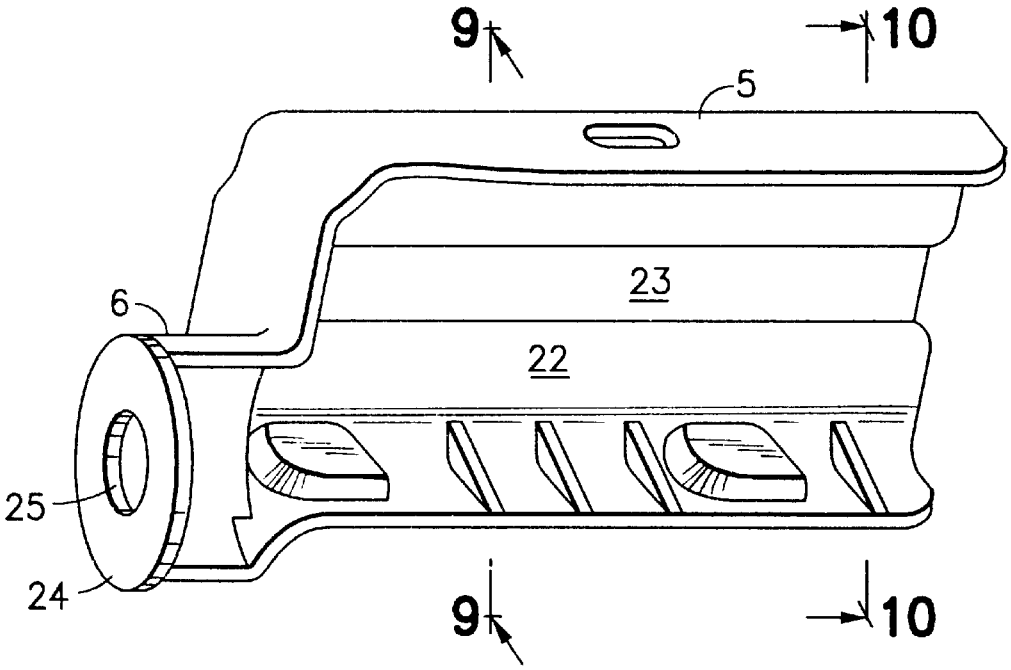
FIG. 7 is a front view of a mounting bracket used in the fuel supply system of this invention.
Figure 8:
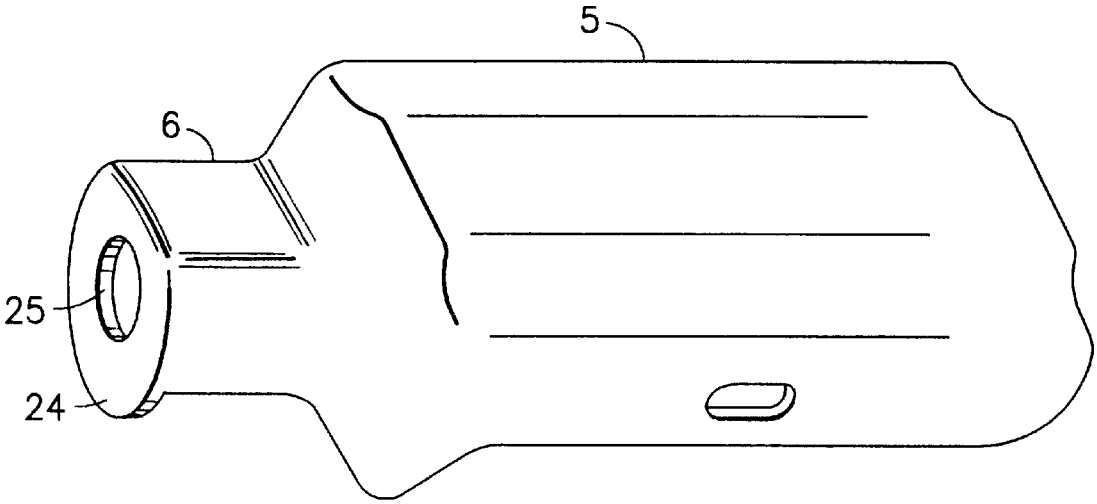
FIG. 8 is a back view of a mounting bracket used in the fuel supply system of this invention.
Figure 10:
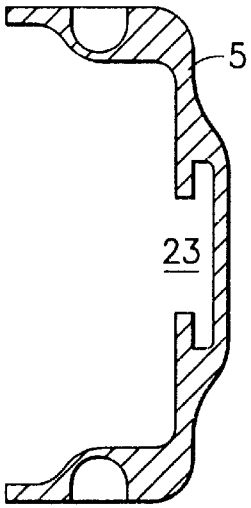
FIG. 10 is a sectional view of a mounting bracket used in the fuel supply system of this invention, taken along section lines 10—10.

The fuel tank 7, as shown in FIGS. 4–6, is a container constructed of high density polyethylene or other suitable material which is capable of being recycled. A key flange 16 is integrally molded at the upper surface 15 of the tank 7, for engagement with a key slot constructed in the mounting bracket 5 described in more detail below. The longitudinal cross section, as shown in FIG. 5, is shaped to allow fuel to collect towards the outlet 17, located at a corner of the lower most end 18 of the tank 7. The bottom 19 of the tank 7 slopes downward towards the outlet to allow the tank 7 to be completely drained without leaving any residue. A suitable male coupling 9 is shown in FIG. 5 secured within outlet 17. The coupling 9 is secured by threads 21 or molded within outlet 17 and is constructed with a shut off valve that is opened by engagement with the mating coupling part. It is essential that the coupling be selected with low cost as an objective since this component will be discarded with the fuel tank. The fuel tank 7 is designed to fit the bracket 5 and this allows for a more universal shape for the fuel tank. It is also designed to accommodate the filling process as well as a variety of tools in a product line. For the applications presently under consideration, the fuel tank is constructed with a capacity of between 8 to 12 fluid ounces.

Figure 9:
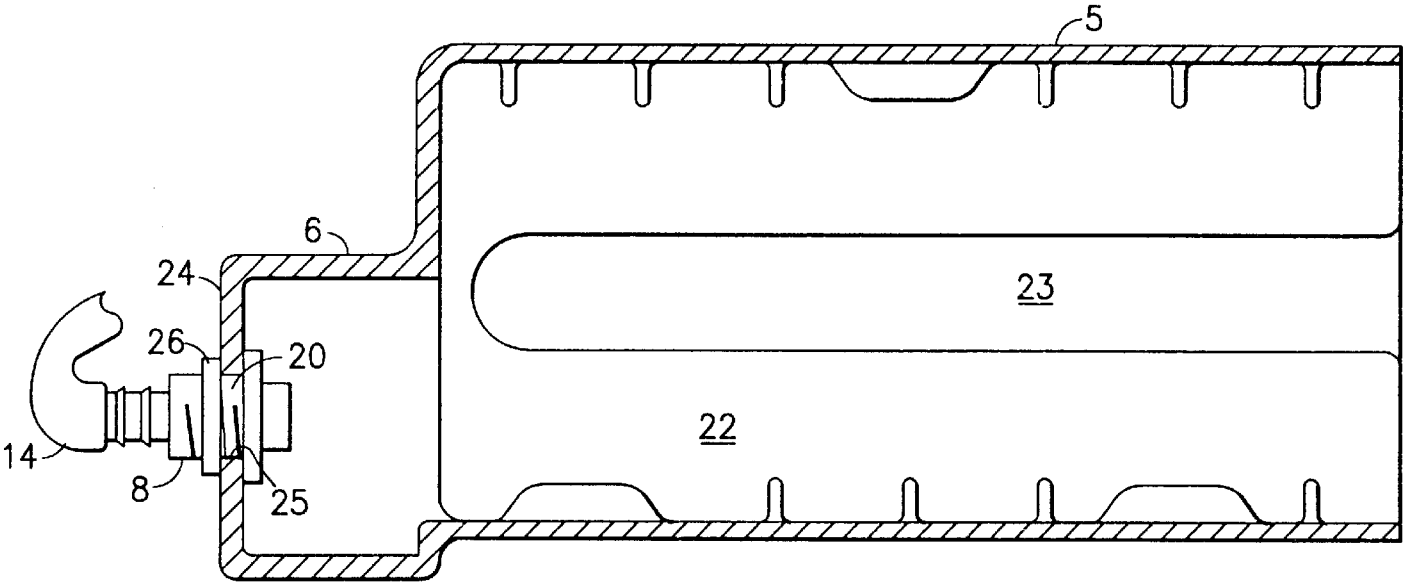
FIG. 9 is a sectional view of a mounting bracket used in the fuel supply system of this invention, taken along section lines 9—9.

The fuel tank bracket 5 is constructed of molded plastic or metal to fit within the fuel tank envelope of a particular product, for example, the string trimmer engine 1, shown in FIG. 1. This will be a component of the engine 1 and mounted on the engine when sold. An interior cavity 22 is enclosed by the structure of bracket 5 and will be generally uniform in shape to accommodate the fuel tank 7, no matter what the dictates of the fuel tank envelope of a particular engine demands. A generally cylindrical flange or spout 6 extends outward from the bracket 5 to provide a structural seat 24 for the mating coupling 8. The coupling 8 is shown as a female coupling in FIG. 9 and receives the coupling 9 of the fuel tank 7 when the tank 7 is assembled within the cavity 22. A T-slot 23 is molded into the bracket 5 and opens into the interior cavity 22 to allow engagement with the T-shaped key 16 of fuel tank 7. The means to engage and secure the tank 7 within the cavity 22 of bracket 5 may vary in design, but it is essential that the tank be secured in a manner which will insure maintenance of the fluid communication of the tank 7 within the fuel system 3. This key and slot engagement effectively retains the fuel tank 7 in position within the bracket 5. The engagement of the coupling components 8 and 9 will also provide a retaining force. Coupling component 8 is mounted within a hole 25 constructed in the seat 24 of spout 6 and is held securely in place by nut 26 which engages threads 20.

Figure 2:
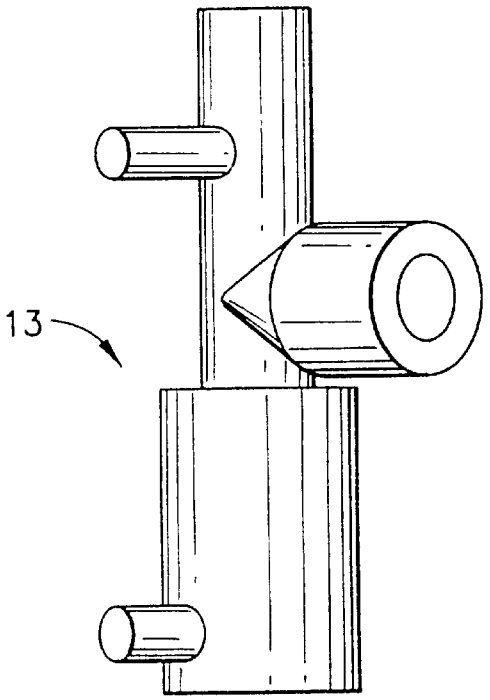
FIG. 2 is a perspective view of a manifold used in conjunction with the fuel supply system of this invention.
Figure 3:
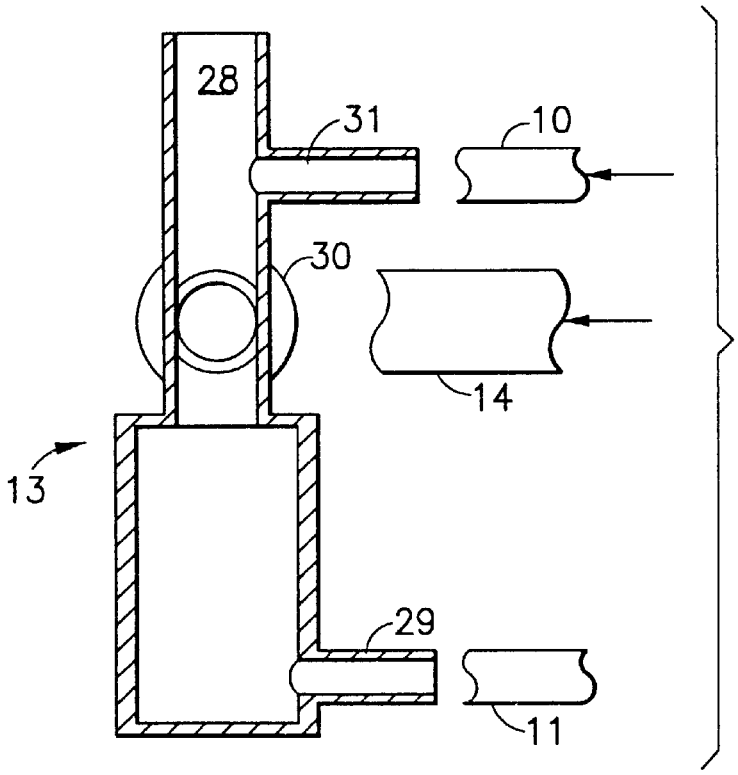
FIG. 3 is a sectional view of the manifold of FIG. 2 taken along section lines 3—3.

The engine 1 is connected to the fuel supply system 3 via manifold 13, as best shown in FIGS. 2 and 3. Manifold 13 is essentially a tube constructed of steel and enclosing an enlarged reservoir section 27 and a vent section 28 in communication therewith. The manifold 13 serves multiple functions. It provides a vent for the system 3 at its upper open end. At its lower end, it provides a feed junction 29, communicating with the carburetor inlet line 11, to supply fuel from fuel tank 7 to the carburetor 12. At an intermediate point, there is constructed an input feed junction 30, communicating with the fuel conduit 14 from the fuel tank 7, to allow fuel to flow through reservoir 27. An upper junction 31 communicates with a purge or primer bulb fluid circuit to allow fuel to be pumped through the carburetor 12. Fuel is fed through the manifold 13 by gravity and, therefore, proper orientation of the manifold 13 and the tank 5 is required to insure functioning of the fuel supply system 3 shown. Reservoir 27 remains filled with fuel to maintain a fluid seal for the carburetor feed line 11. This prevents air bubbles which may cause a decrease in performance or shut down of the engine altogether.

In operation, the tank support bracket 5 is designed to accommodate the particular engine with which is to be used. The cavity 23 is constructed to receive the fuel tank 7 which is a more universal shape for use with multiple engine models or designs. The fuel tank 7 comprises a sealed unit when assembled with the coupling 9. The tank 7 is filled with fuel either through the coupling 9 or other convenient means. The fuel is optimized for the particular engine including premixed oil and other additives which reduce emissions and improve engine performance. The tank 7 is, therefore, supplied to the user ready for use and is not intended for refilling. This removes the necessity for the user to measure a fuel to oil mixture and fill the tank, thereby avoiding the spills, emissions and errors normally associated with such activities. The tank 7 is mounted on the bracket 5 and coupled to the fuel supply system through a snap in fitting 8,9 which allows convenient connection and removal of the tank 7 from the system. The complexity and cost of the tank 5 is minimized by the use of manifold 13 which vents the system 3 and provides a junction means to connect the fuel feed line 11 to the engine carburetor 12. It also connects the fuel primer or purging line 10 to the fuel system 3. The reservoir 27 is a small enlarged section of the manifold passage which acts to retain a small amount of fuel. This provides a continuous seal for the fuel feed line 11.

In this manner a convenient fuel supply system is provided which includes a sealed disposable fuel container for use without filling or mixing. The fuel itself maybe optimized for emissions and performance. By making the tank from recyclable materials, the environmental impact of the fuel supply system is minimized while reducing engine emissions.

What is claimed is:

1. A fuel supply system, including fuel feed means, for internal combustion engines used to power garden tools and the like comprising:

a mounting bracket constructed for attachment to the engine and defining an open recess for removably securing a prefilled fuel tank;

a first coupling means mounted on said mounting bracket and connected to the fuel feed means to releasably connect said feed means to the fuel tank for fluid communication;

a disposable fuel tank prefilled with fuel is constructed to engage the open recess of the mounting bracket for retention therein; and a second coupling means mounted on the disposable fuel tank for mating with the first coupling means to releasably connect the fuel tank to the feed means for fluid communication.

2. A fuel supply system, including fuel feed means, for internal combustion engines used to power garden tools and the like, as described in claim 1, further comprising venting means independent of the fuel tank and connected to the fuel feed means to vent the fuel supply system.

3. A fuel supply system, including fuel feed means, for internal combustion engines used to power garden tools and the like, as described in claim 1, further comprising first engagement means formed as part of the bracket and second engagement means formed as part of the tank, said engagement means being constructed to mate and secure the tank in assembled relation to the bracket.

4. A fuel supply system, including fuel feed means, for internal combustion engines used to power garden tools and the like, as described in claim 3, wherein the engagement means comprise an elongated key slot constructed in the bracket and opening into the cavity and an elongated key constructed on the fuel tank and extending outward therefrom to mate with the key slot to secure the fuel tank within the cavity.

5. A fuel supply system, including fuel feed means, for internal combustion engines used to power garden tools and the like, as described in claim 1, wherein the bracket includes an outward projecting flange to which is fixed the first coupling.

6. A fuel supply system, including fuel feed means, for internal combustion engines used to power garden tools and the like, as described in claim 1, wherein the first and second couplings include valves which shut off the fuel supply system and the fuel tank when each is disconnected from the other.

7. A fuel supply system, including fuel feed means, for internal combustion engines used to power garden tools and the like, as described in claim 1, wherein the fuel tank is prefilled with a fuel mixture designed to optimize performance and minimize emissions.

8. A fuel supply system, including fuel feed means, for internal combustion engines used to power garden tools and the like, as described in claim 1, wherein the fuel tank is constructed of a material which is disposable and recyclable.

9. A fuel supply system, including fuel feed means, for internal combustion engines used to power garden tools and the like, as described in claim 1, wherein the fuel feed means include a purging line and a feed line and the venting means comprises:

a manifold having a top and a bottom constructed with first and second interconnected passages, said first passage being larger than the second passage; said first passage providing a reservoir for fuel and said second passage being open to ambient pressure;

a first junction constructed at the bottom of the manifold, said first junction communicating with the first passage to provide a connection to the feed line through the reservoir;

a second junction constructed at the top of the manifold, said second junction communicating with the second passage to provide a connection with the purging line; and a third junction constructed between said first and second junctions communicating with the second passage to provide a connection to the fuel tank.

10. A fuel supply system, including fuel feed means, for internal combustion engines used to power garden tools and the like, as described in claim 9, wherein the reservoir is normally filled with fuel to create a fluid seal for the feed line.

11. A fuel supply system, including fuel feed means, for internal combustion engines used to power garden tools and the like, as described in claim 9, wherein the fuel is urged through the first passage by gravity.

* * * * *